United States Patent [19]

Heard et al.

[11] 4,027,685

[45] June 7, 1977

[54] METHOD FOR PROCESSING USED EMULSION COOLANT

[75] Inventors: George E. Heard, Golden; Thomas Buchanan McPherson, IV, Arvada, both of Colo.

[73] Assignee: Coors Container Company, Golden, Colo.

[22] Filed: June 9, 1976

[21] Appl. No.: 694,283

[52] U.S. Cl. ..... 134/10; 210/43; 210/73; 134/41; 260/412.5

[51] Int. Cl.[2] ..... C23G 1/02

[58] Field of Search ..... 210/43, 44, 59, 60, 210/73 W, 74, DIG. 27; 134/10, 40, 41, 109; 260/412.5

[56] References Cited

UNITED STATES PATENTS

| | | | |
|---|---|---|---|
| 3,243,446 | 3/1966 | Funk | 260/412.5 |
| 3,301,779 | 1/1967 | Kovacs | 210/44 |
| 3,471,533 | 10/1969 | Kovacs | 260/412.5 |
| 3,846,173 | 11/1974 | Ihrig | 210/43 |

FOREIGN PATENTS OR APPLICATIONS

| | | | |
|---|---|---|---|
| 1,475,383 | 3/1967 | France | 210/43 |

*Primary Examiner*—Frank A. Spear, Jr.
*Assistant Examiner*—Benoit Castel
*Attorney, Agent, or Firm*—Bruce G. Klaas; Dennis K. Shelton

[57] ABSTRACT

Used oil and water emulsion coolant recovered from can bodies in a can manufacturing process is processed to form reconstituted emulsion coolant by washing emulsion coolant adhering to can bodies off of the cans with an aqueous solution having a pH less than about 2.0 thereby forming a mixture of the emulsion coolant and the aqueous solution, heating the mixture to an elevated temperature sufficient to break a substantial portion of the emulsion coolant into a predominately hydrocarbon phase and a predominately aqueous phase, separating the predominately hydrocarbon phase from the predominately aqueous phase, adding a sufficient amount of water to the predominately hydrocarbon phase to reconstitute the emulsion coolant, adding a sufficient amount of an emulsifying agent or agents to the predominately hydrocarbon phase and the water to emulsify the predominately hydrocarbon phase and the water, and filtering the predominately hydrocarbon phase, the water and the emulsifying agent to form reconstituted emulsion coolant.

12 Claims, 1 Drawing Figure

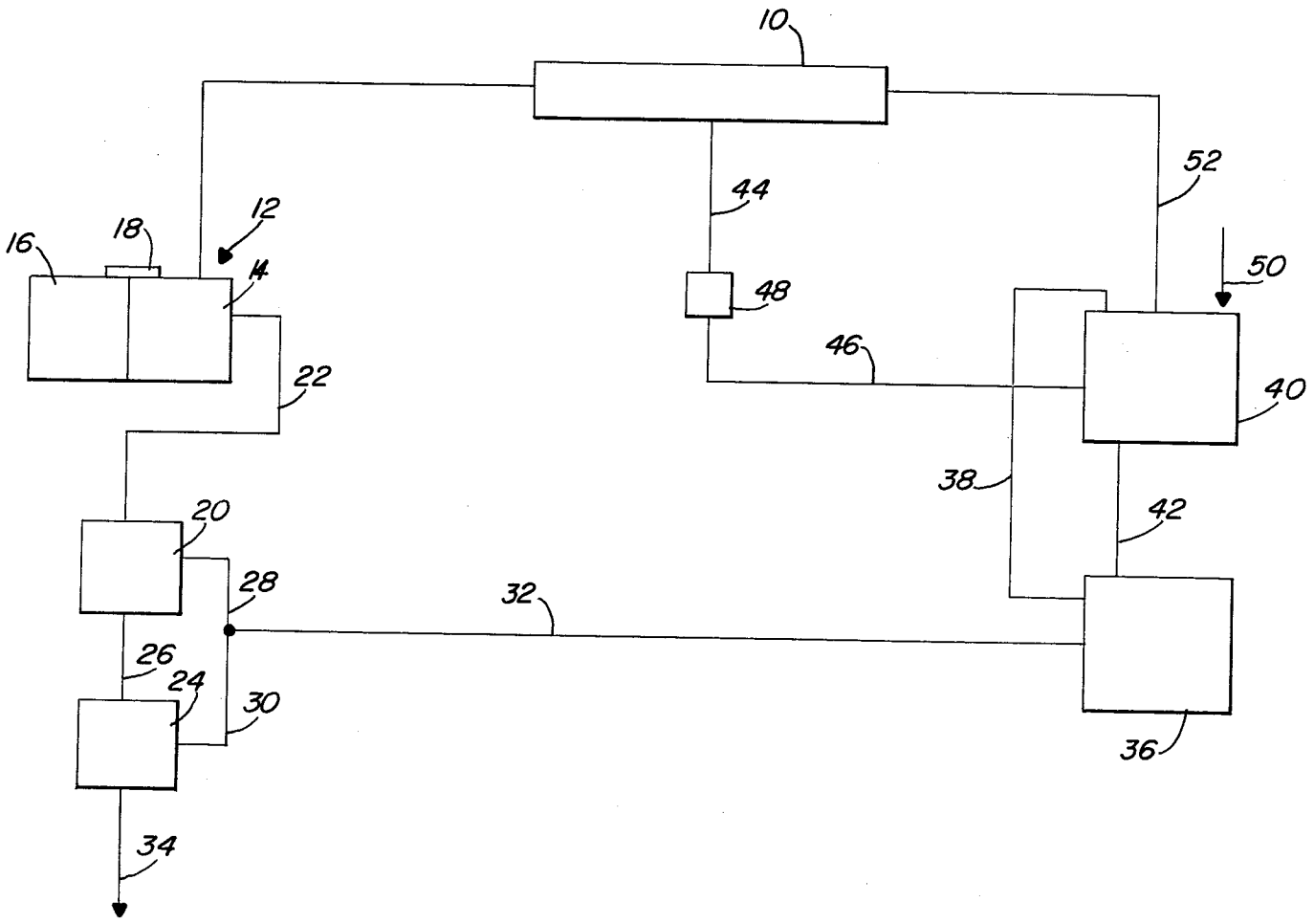
10
12
14
16
18
20
22
24
26
28
30
32
34
36
38
40
42
44
46
48
50
52

METHOD FOR PROCESSING USED EMULSION COOLANT

BACKGROUND AND SUMMARY OF THE INVENTION

This invention relates to a method of processing used coolant and more particularly to a method of processing used oil and water emulsion coolant recovered from can bodies in a can manufacturing process to reconstitute and permit the reuse of the used oil and water emulsion coolant.

In the can manufacturing industry, and particularly in the aluminum beverage can manufacturing industry, cans are commonly manufactured in high speed production lines involving the steps of cupping, bodymaking, trimming, washing, printing, internal coating and necking and flanging. In the cupping step, sheet material, such as sheet aluminum, is lubricated with an oil and water emulsion coolant and is then stamped into relatively short height and relatively large diameter cups. In the bodymaking step, each cup is forced by a moving ram through a series of concentric ironing dies that stretch the cup to form a relatively taller height and a relatively smaller diameter can body, approximating the size of the product cans. In both the cupping and bodymaking steps, the sheet material is covered with the coolant to lubricate the sheet material and to dissipate heat generated by the process of stretching and forming the sheet material. After the can bodies have been trimmed, they are carried through a multiple stage can body washer which removes the used coolant and metal fines from the can bodies. The used coolant is then commonly discarded when the used wash water is treated in conventional waste water treatment facilities.

It has now been discovered that used oil and water emulsion coolant recovered from can bodies in a can manufacturing process can be processed for reuse to form reconstituted emulsion coolant by washing the coolant adhering to can bodies off of the bodies with an aqueous solution having a pH less than about 2.0 thereby forming a mixture of the emulsion coolant and the aqueous solution, heating the mixture to an elevated temperature sufficient to break a substantial portion of the emulsion into a first predominately hydrocarbon phase and a first predominately aqueous phase, separating the first predominately hydrocarbon phase from the first predominately aqueous phase, adding a sufficient amount of water to the first predominately hydrocarbon phase to reconstitute the emulsion coolant, adding a sufficient amount of an emulsifying agent or agents to the first predominately hydrocarbon phase and the water to emulsify the first predominately hydrocarbon phase and the water, and filtering the first predominately, hydrocarbon phase, the water and the emulsifying agent to form reconstituted emulsion coolant. Additionally, the separated predominately aqueous phase may be heated to a second relatively higher elevated temperature level sufficient to break a substantial portion of any emulsion coolant remaining in the predominately aqueous phase into a second predominately hydrocarbon phase and a second predominately aqueous phase. The second predominately hydrocarbon phase may then be recombined with the first predominately hydrocarbon phase prior to reconstituting the emulsion coolant.

BRIEF DESCRIPTION OF THE DRAWING

The accompanying drawing is a schematic drawing illustrating the inventive concepts.

DESCRIPTION OF ILLUSTRATIVE EMBODIMENTS OF THE INVENTION

Referring now to the accompanying drawing, oil and water emulsion coolant used to coat can bodies in can manufacturing apparatus, such as bodymaker 10, is removed from the can bodies in multistage can washing apparatus 12 and subsequently processed according to the inventive concepts in apparatus generally illustrated in the drawing as settling tank 20, settling tank 24, mixing tank 36 and filter 40.

Coolants useful with the present invention are generally oil and water emulsion coolants, such as Texaco Emulsifiable Oil, manufactured by Texaco, Inc., Post Office Box 712, Port Arthur, Texas 77640; Quaker 538 Emulsifiable Oil, manufactured by Quaker Chemical Corp., Conshohocken, Pennsylvania 19428; Nalco XL174, manufactured by Nalco Chemical Co., 9165 South Harbor Avenue, Chicago, Illinois 60617, and the like which serve as lubricants and heat dissipators in can manufacturing apparatus, such as bodymaker 10, for manufacturing cans from sheet material, such as aluminum. The coolant is applied to the sheet material prior to the cupping and bodymaking steps of the can manufacturing process and after trimming of the cans, the coolant must be removed prior to further processing of the can bodies. The emulsion coolant is recovered by washing the coolant adhering to the can bodies off of the cans with an aqueous solution having a pH less than about 5.0 thereby forming a mixture of the emulsion coolant and the aqueous solution. This may be accomplished in conventional multistage can washing apparatus 12, the first two stages of which are illustrated in FIG. 1 and in which the first stage 14 contains an aqueous acidic solution, such as an aqueous sulfuric acid solution, having a pH in the range of about 1.7 to about 2.0, preferably about 1.75, and the second stage 16 contains an aqueous solution having a pH in the range of about 1.25 to about 2.0, preferably about 1.4. The washing step may be facilitated by heating the aqueous acid solutions in the first and second stages of the can washing apparatus to an elevated temperature, e.g., to about 150° to about 200° F. The aqueous solution in the second stage 16 of the can washing apparatus is overflowed into the first stage 14, as, for example, through overflow conduit section 18 and the aqueous solution in the first stage is overflowed into settling tank 20, as, for example, through overflow conduit section 22.

In settling tank 20, the mixture of the aqueous wash solution and the recovered oil and water emulsion coolant is heated to a first elevated temperature level, e.g., about 100° to about 150° F, sufficient to break a substantial portion of the oil and water emulsion coolant into a first predominately hydrocarbon phase and a first predominately aqueous phase. The mixture is then allowed to settle in settling tank 20 for a sufficient period of time to allow the first predominately aqueous phase to settle from the first predominately hydrocarbon phase due to a difference in specific gravities between the two phases. The first predominately hydrocarbon phase is then separated from the first predominately aqueous phase, as, for example, by skimming the first predominately hydrocarbon phase from the first predominately aqueous phase or by draining the first predominately aqueous phase from the bottom of settling tank 20.

The separated first predominately aqueous phase may then be transferred to settling tank 24 through conduit section 26, for recovery of additional coolant from the first predominately aqueous phase, where it is heated to a second, increased elevated temperature level, e.g., about 140° F, to about 190° F, sufficient to break a substantial portion of emulsion coolant remaining in the first predominately aqueous phase into a second predominately hydrocarbon phase and a second predominately aqueous phase. The second predominately aqueous phase is then allowed to settle out of the second predominately hydrocarbon phase and the second predominately hydrocarbon phase is separated from the second predominately aqueous phase, as, for example, by skimming the second predominately hydrocarbon phase off of the second predominately aqueous phase or by draining the second predominately aqueous phase from the bottom of tank 24. The first and second predominately hydrocarbon phases are removed from settling tanks 20, 24, as, for example, through conduit sections 28, 30, combined into a combined predominately hydrocarbon phase in conduit section 32 and transported through conduit section 32 to mixing tank 36. The second predominately aqueous phase is removed from settling tank 24 through conduit section 34 and transferred to a conventional waste water treatment system.

In mixing tank 36, sufficient water, e.g., from about 69.75 to about 82.75% water by volume, is added to the combined predominately hydrocarbon phase, to reconstitute the oil and water emulsion coolant. Additionally, a sufficient amount of a suitable emulsifying agent is added to the combined hydrocarbon phase and water to emulsify the combined hydrocarbon phases and the water. The emulsifying agent can be any agent capable of emulsifying the combined hydrocarbon phases and the water which does not have a deleterious effect on the lubrication and heat dissipation properties of the coolant. For example, the emulsifying agent may comprise from about 0.075 to about 0.15% by volume monoethanolamine, from about 0.075 to about 0.15% by volume triethanolamine and from about 0.075 to about 0.15% by volume triethylene glycol. Additionally, from about 0 to about 0.55% by volume of oleic acid may be added to enhance the lubrication properties of the reconstituted emulsion coolant.

The combined predominately hydrocarbon phase, the water and the emulsifying agent are then mixed and purified by recirculating the hydrocarbon phase, the water and the emulsifying agent through conduit section 38, filter 40, such as a Hoffman filter, and conduit section 42, for a sufficient period of time, e.g., from about fifteen minutes to about one hour, to emulsify the hydrocarbon phase and the water. The combined predominately hydrocarbon phase, the water and the emulsifying agent may additionally be heated to a temperature in the range of about 90° to about 110° F prior to filtration to reduce the viscosity of the hydrocarbon phase and thereby enhance mixing of the emulsion.

Filter 40 may additionally receive used oil and water emulsion coolant directly from the can making apparatus, such as bodymaker 10, as, for example, through conduit sections 44, 46, and coolant sump 48. Virgin coolant may also be added to the system into filter 40 through conduit section 50 from a suitable supply source (not shown) as necessary to replenish the supply of coolant to bodymaker 10.

The filtered coolant, comprising reconstituted coolant from mixing tank 36, or reconstituted coolant combined with used coolant from coolant sump 48 and virgin coolant received through conduit section 50 is then injected into the machinery's coolant supply system, as, for example, through conduit section 52.

The present invention provides an easy and economical method of reclaiming and reconstituting used oil and water emulsion coolant which is commonly lost in can making operations in the can body washer. It is therefore capable of significantly decreasing production costs normally associated with virgin coolant requirements.

While the present invention has been described in association with a presently preferred embodiment of the inventive concepts, various modifications will be apparent to a person skilled in the art. It is intended that such modifications be included within the scope of the appended claims, except insofar as they are precluded by the prior art.

What is claimed is:

1. A method of recovering used oil and water emulsion coolant from can bodies in a can making process and processing the coolant to form reconstituted emulsion coolant comprising:

washing emulsion coolant adhering to can bodies off of the can bodies with an aqueous solution having a pH less than about 5.0 thereby forming a mixture of the emulsion coolant and the aqueous solution, heating the mixture to an elevated temperature sufficient to break a substantial portion of the emulsion coolant into a predominately hydrocarbon phase and a predominately aqueous phase said elevated temperature being at least 100° F, settling the predominately aqueous phase from the predominately hydrocarbon phase, separating the predominately hydrocarbon phase from the predominately aqueous phase, adding a sufficient amount of water to the predominately hydrocarbon phase to reconstitute the emulsion coolant, adding a sufficient amount of an emulsifying agent to the predominately hydrocarbon phase and the water to emulsify the predominately hydrocarbon phase and the water, and filtering the predominately hydrocarbon phase, the water and the emulsifying agent to form reconstituted emulsion coolant.

2. The method of claim 1 wherein the emulsion coolant is washed off of the can bodies with an aqueous solution having a pH less than about 2.0 and a temperature in the range of about 150° F to about 200° F.

3. The method of claim 1 which further comprises separating the predominately hydrocarbon phase from the predominately aqueous phase by skimming the predominately hydrocarbon phase from the settled predominately aqueous phase.

4. The method of claim 1 wherein the mixture is heated to a temperature in the range of about 100° to about 150° F to break a substantial portion of the emulsion coolant into the predominately hydrocarbon phase and the predominately aqueous phase.

5. The method of claim 1 wherein the predominately hydrocarbon phase, the water and the emulsifying agent are heated to a temperature in the range of about 90° to about 110° F prior to filtering the predominately hydrocarbon phase, the water and the emulsifying agent to form reconstituted emulsion coolant.

6. The method of claim 1 wherein the emulsifying agent comprises monoethanol amine, triethanolamine and triethylene glycol.

7. The method of claim 6 which further comprises adding oleic acid in an amount up to about 0.55% by volume to the predominately hydrocarbon phase and the water.

8. A method of processing used oil and water emulsion coolant recovered from can bodies in an aluminum can making process to form reconstituted emulsion coolant comprising:

washing coolant adhering to can bodies off of the can bodies with an aqueous solution having a pH less than about 5.0 to thereby form a mixture of the coolant and the aqueous solution, heating the mixture to a temperature of about 100° F to about 150° F, settling the mixture to form a first predominately hydrocarbon phase and a first predominately aqueous phase, separating the first predominately hydrocarbon phase from the first predominately aqueous phase, heating the first predominately aqueous phase to a temperature of about 140° F to about 190° F, settling the heated first predominately aqueous phase to form a second predominately hydrocarbon phase and a second predominately aqueous phase, separating the second predominately hydrocarbon phase from the second predominately aqueous phase, combining the first predominately hydrocarbon phase with the second predominately hydrocarbon phase to form a combined predominately hydrocarbon phase, adding a sufficient amount of water to the combined predominately hydrocarbon phase to reconstitute the coolant, adding a sufficient amount of an emulsifying agent to the combined predominately hydrocarbon phase and the water to re-emulsify the combined hydrocarbon phase and the water, filtering the combined predominately hydrocarbon phase, the water and the emulsifying agent to re-emulsify the combined hydrocarbon phase, the water and the emulsifying agent to form reconstituted emulsion coolant.

9. The method of claim 8 wherein the emulsion coolant is washed off of the can bodies with an aqueous solution having a pH less than about 2.0 and a temperature in the range of about 150° F to about 200° F.

10. The method of claim 8 wherein the combined hydrocarbon phase, the water and the emulsifying agent are heated to a temperature in the range of about 90° to about 110° F prior to filtering the combined hydrocarbon phase, the water and the coolant to form reconstituted emulsion coolant.

11. The method of claim 8 wherein the emulsifying agent comprises monoethanolamine, triethanolamine, triethylene glycol and oleic acid.

12. The method of claim 8 which further comprises adding oleic acid in an amount up to about 0.55% by volume to the combined predominately hydrocarbon phase and the water prior to filtering the combined predominately hydrocarbon phase, the water and the emulsifying agent.

* * * * *